US005199640A

United States Patent [19]

Ursic

[11] Patent Number: 5,199,640

[45] Date of Patent: Apr. 6, 1993

[54] SHOCK MOUNTED HIGH PRESSURE FLUID JET ORIFICE ASSEMBLY AND METHOD OF MOUNTING FLUID JET ORIFICE MEMBER

[76] Inventor: Thomas A. Ursic, 12 Bedford Dr., West Trenton, N.J. 08628

[21] Appl. No.: 760,616

[22] Filed: Sep. 16, 1991

[51] Int. Cl.[5] ..... B05B 15/06

[52] U.S. Cl. ..... 239/11; 239/596; 239/602

[58] Field of Search ..... 239/11, 589, 596, 602; 285/305, 917

[56] References Cited

U.S. PATENT DOCUMENTS

| | | | |
|---|---|---|---|
| 3,084,751 | 4/1963 | Scarborough | 285/305 X |
| 3,705,693 | 12/1972 | Franz | 239/602 X |
| 3,750,961 | 8/1973 | Franz | 239/596 X |
| 3,997,111 | 12/1976 | Thomas et al. | 239/596 X |
| 4,131,236 | 12/1978 | Saunders | 239/596 X |
| 4,150,794 | 4/1979 | Higgins | 239/596 |
| 4,199,107 | 4/1980 | Bingham | 239/596 X |
| 4,244,521 | 1/1981 | Guse | 239/596 X |
| 5,033,681 | 7/1991 | Munoz | 239/602 X |

FOREIGN PATENT DOCUMENTS 1199271 12/1985 U.S.S.R. ..... 239/596

*Primary Examiner*—Kevin P. Shaver
*Assistant Examiner*—William Grant
*Attorney, Agent, or Firm*—Ostrolenk, Faber, Gerb & Soffen

[57] ABSTRACT

An orifice assembly for emitting a stream of fluid under high pressure has an orifice member having an aperture therein through which a high pressure fluid is emitted, a support member on which the orifice member is disposed, the support member providing support for the orifice member and being flexible in response to the application of high pressure fluid to the orifice member and having a passageway therein in communication with the aperture in the orifice member. Because of the flexing of the support member on which the orifice member is disposed, the orifice member is allowed to move in response to the application of the high pressure fluid, reducing damage to the orifice member due to shock from the high pressure fluid, particularly when cycling on and off. A housing has an opening for receiving the orifice member and support member therein, and a retainer holds the orifice member and support member in the housing.

32 Claims, 2 Drawing Sheets

SHOCK MOUNTED HIGH PRESSURE FLUID JET ORIFICE ASSEMBLY AND METHOD OF MOUNTING FLUID JET ORIFICE MEMBER

BACKGROUND OF THE INVENTION

The present invention relates to high pressure fluid jets, e.g., waterjets, and in particular, to a shock mounted high pressure fluid jet orifice assembly and method of mounting a fluid jet orifice member. Such fluid jets are used, for example, for cutting materials, for example, leather, plastic, metals, and such materials as stone and concrete. One application is, for example, the quarrying of blocks of stone, and other applications are the cutting of fabrics for clothing and leather or plastic materials for shoes.

In equipment for producing fluid jets, typically water or another fluid under very high pressure is supplied through a supply tube to a nozzle having an orifice disposed therein. The orifice has a small aperture for the exit of the water or other fluid under high pressure from the nozzle. The orifice, typically made of a very hard material, for example, sapphire, is under tremendous pressure, and particularly when the fluid jet is turned on or off or cycled on or off repeatedly, the orifice, typically a separate piece at the end of the nozzle, is subjected to sudden and rapid shocking and pounding forces due to application of the high pressure fluid, causing premature failure of the orifice.

SUMMARY OF THE INVENTION

It is an object of the present invention to provide an orifice assembly for a high pressure fluid jet.

It is yet still a further object of the present invention to provide an orifice assembly for a high pressure fluid jet which is capable of withstanding the rapid application and turn off of high pressure fluid and the severe shocking and pounding of the orifice element itself without premature failure.

It is yet still a further object of the present invention to provide such an orifice assembly for a high pressure fluid jet which lasts longer in high cycle on-off applications than the orifices presently in use.

It is yet still another object of the present invention to provide such an orifice assembly for a high pressure fluid jet which is shock mounted in a nozzle to provide longevity to the orifice element.

It is yet still a further object to provide a resilient mounting member for a high pressure fluid jet orifice.

The above and other objects of the present invention are achieved by an orifice assembly for emitting a stream of fluid under high pressure comprising an orifice member having an aperture therein through which a high pressure fluid is emitted as the stream, a support member disposed downstream of the orifice member, the support member providing support for the orifice member, being flexible in response to the application of high pressure fluid to the orifice member and having a passageway therein in communication with the aperture in the orifice member, whereby the orifice member is allowed to move in response to the application of high pressure fluid, a housing having an opening for receiving the orifice member and support member therein, and means for retaining the orifice member and support member in the housing.

According to another aspect, the invention comprises a support member for a high pressure fluid jet orifice member adapted to be disposed in a housing, the orifice member adapted to produce a fluid jet stream, the support member comprising an annular member having an upstream surface adapted to support the orifice member and having a central opening therein in communication with an aperture in the orifice member and through which the fluid jet stream from the orifice member flows, said annular member being flexible in response to the application of high pressure fluid to the orifice member, thereby allowing the orifice member to move in response to the application of the high pressure fluid.

According to yet still another aspect, the invention comprises a method for mounting a high pressure fluid jet orifice member from which a high pressure fluid jet stream is produced, the method comprising mounting the orifice member on a support member in a cavity in a housing, the support member being disposed downstream of the orifice member and having an opening therein for allowing fluid to flow through the support member, and allowing the support member to flex in response to the application of high pressure fluid to the orifice member, thereby allowing the orifice member to move in response to the application of the high pressure fluid.

Other features and advantages of the present invention will become apparent from the following detailed description of the invention.

BRIEF DESCRIPTION OF THE DRAWINGS

The invention will now be described in greater detail in the following detailed description with reference to the drawings in which.

DETAILED DESCRIPTION OF THE DRAWINGS

Figure 1:
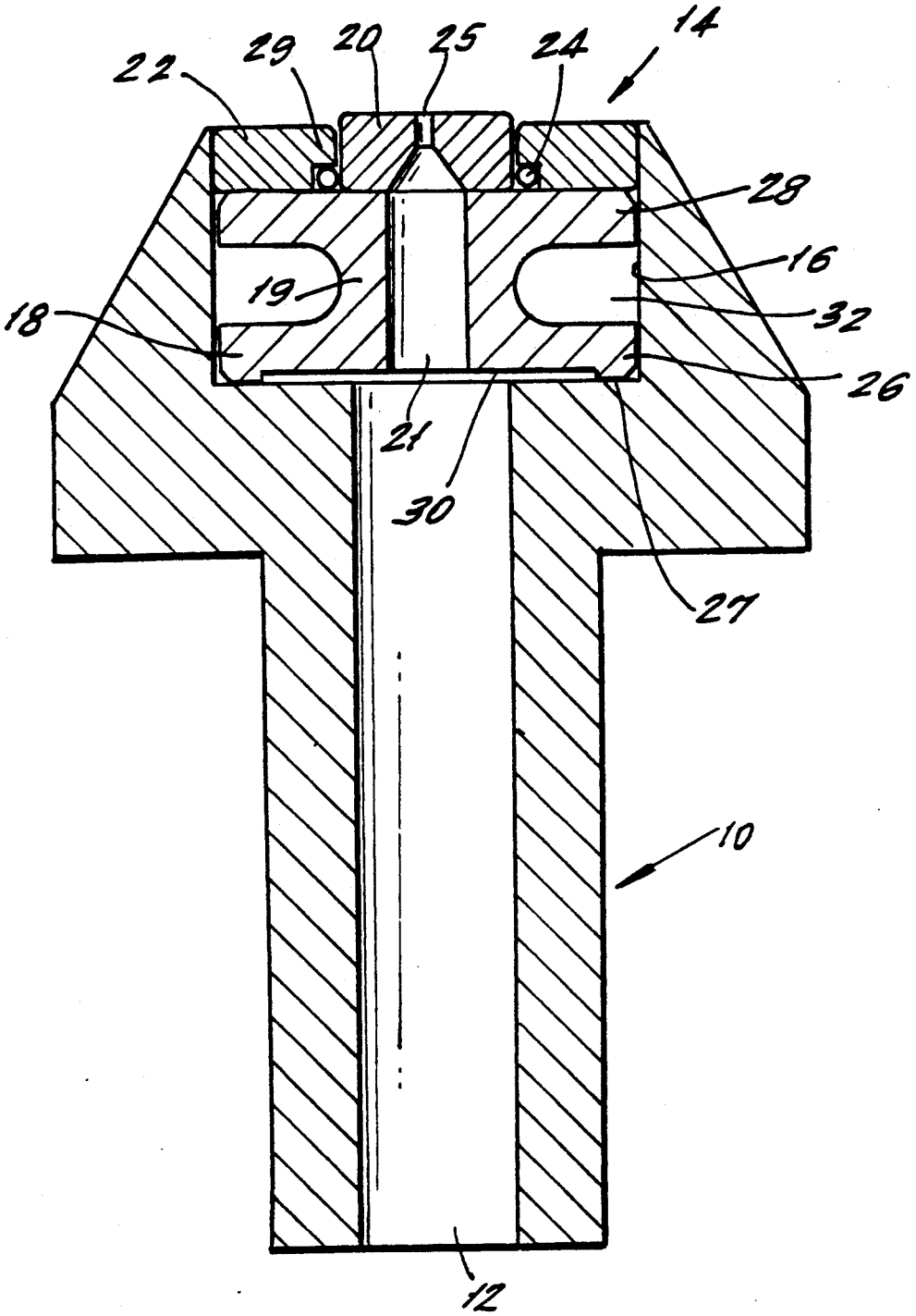
FIG. 1 shows a cross-section through the shock mounted high pressure fluid jet orifice assembly according to the present invention when fluid pressure is not applied.
Figure 2:
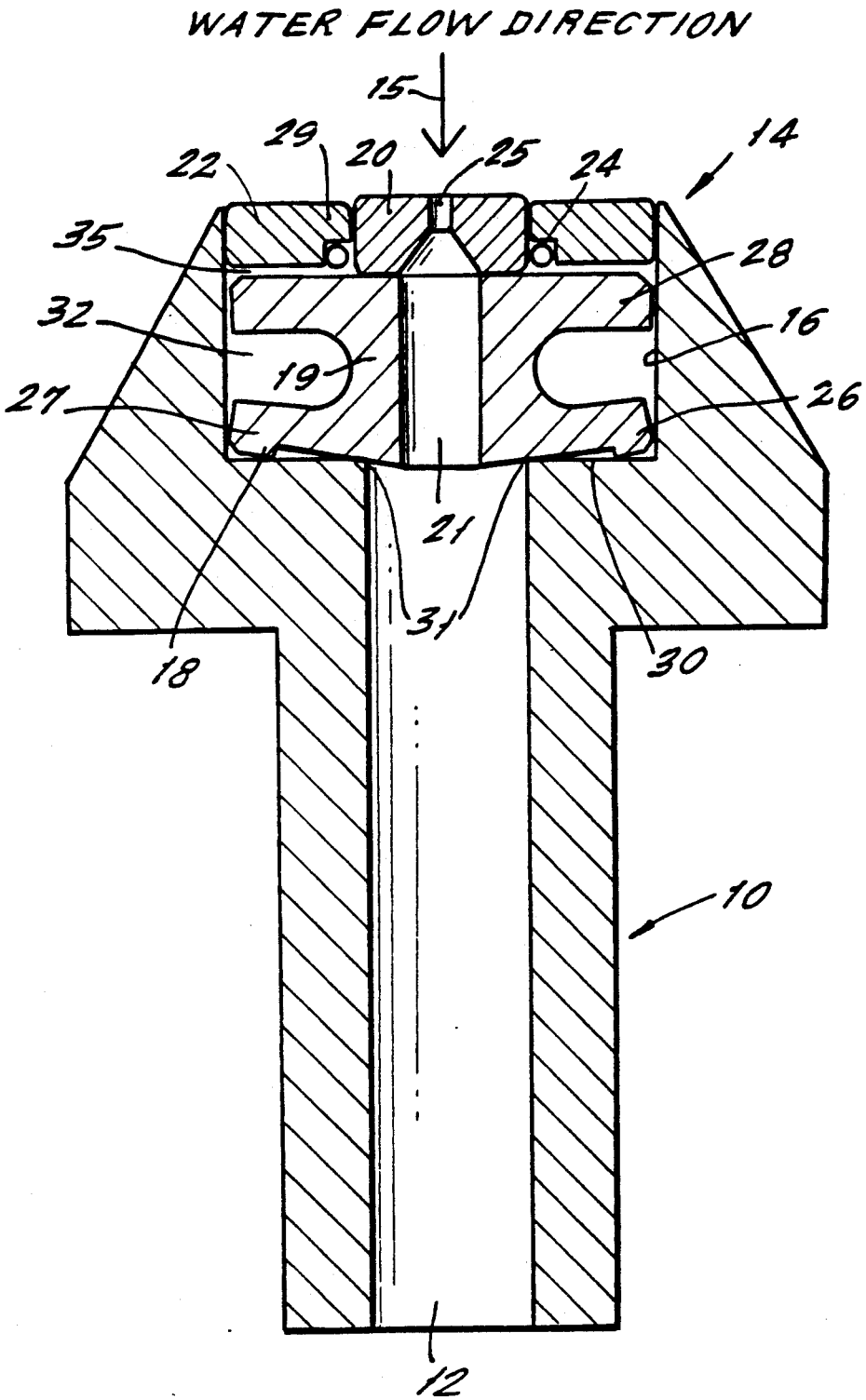
FIG. 2 shows a cross-section through the high pressure fluid jet orifice assembly according to the present invention under the application of high fluid pressure.

With reference now to the drawings, FIGS. 1 and 2 show the high pressure fluid jet orifice assembly according to the present invention. FIG. 1 shows the assembly in an unstressed condition, i.e., not subjected to the pressure exerted by a high pressure fluid, and FIG. 2 shows the fluid jet orifice assembly under the stresses exerted by high pressure fluid, for example, high pressure water over 50,000 psi.

With reference to the drawings, the high pressure fluid jet orifice assembly comprises a housing 10 having a nozzle opening 12 therein through which the high pressure fluid jet is expelled. At the inlet side 14, the housing has an opening 16 in which an orifice member support 18, and orifice member 20, orifice member retainer 22 and orifice member retainer ring 24 are disposed. The orifice member support 18 comprises a generally annular support member having two flanges 26 and 28 integrally formed as a part of the support with a core portion 19. The core portion 19 has a central passageway 21 communicating with the orifice opening 25 and the nozzle opening 12. The support also has a gap 30 formed on the downstream surface thereof, the purpose for which will be explained with reference to FIG. 2. The gap is approximately 0.004–0.005 inch deep and extends over most of the downstream surface of the support, leaving an annular surface 27 engaging housing 10.

In a typical application, orifice member 20 may have an external diameter of 0.08 inch and be 0.033 inch thick, with an aperture 25 at its smallest diameter of 0.003 inch. Support 18 may have a diameter of 0.150 inch with the central passageway having a diameter of 0.04 inch. The support 18 may have a height of 0.09 inch, with the flanges 26 and 28 being 0.03 inch thick. The opening 32 between the flanges may be 0.02 inch deep. The orifice support may be made of any hard metal, but a preferred material is stainless steel.

The orifice member 20 itself comprises a very hard material capable of withstanding the pressures exerted by the high pressure fluid, and typically comprises a sapphire jewel. The retainer ring 24, for example, comprising a C-shaped spring fastener, frictionally grips the perimeter of the orifice member 20. Orifice member 20 is retained from falling out of the assembly when inverted and when not pressurized by fluid by the flange 29 of the orifice member retainer 22. Retainer 22 may be press fit into housing 10. The flange 29 of the orifice member retainer 22, as shown, abuts against the C-shaped retainer ring 24.

As depicted in FIG. 2, which shows the orifice assembly under pressure, fluid under pressure is provided from a suitable source, as shown by the arrow 15 indicating the fluid flow direction. The fluid may be supplied from a conventional supply tube, and the orifice member 20 may be disposed in a housing having an upstream converging section, as disclosed in applicants's copending application, Ser. No. 760,871, filed concurrently herewith, thereby providing a more cohesive fluid jet.

Under the application of pressure from the fluid, the orifice member 20, which is slidably retained in retainer 22, moves toward the orifice support 18, which flexes as shown, such that the gap 30 formed or machined into the downstream surface of the support 18, is substantially closed along an annular surface at 31 under the application of pressure. In this way, when the support flexes, closing the gap, the shock of repeated cycling of the pressurized fluid against the orifice member 20 is taken up by the support. The orifice member 20 thus displaces slightly due to the resilient nature of the support member 18. The support member therefore functions as a spring to absorb the shock of the high pressure fluid cycling on and off. When the pressure is relieved, support 18 and orifice member 20 revert to the position shown in FIG. 1.

Additionally, the annular opening 32 between the flanges 26 and 28 of the support 18 closes up at the outer periphery thereof, as shown in FIG. 2, when pressure is applied to the orifice member. The slight downward motion of the orifice member against the flexible support 18 provides a spring-like effect, which helps to cushion the orifice member and provides a preload to it. The motion of the orifice member stops when the support 18 has reached the end of its travel when the gap 30 closes up. As shown, when gap 30 closes up and the support member flexes, a gap 35 opens between retainer 22 and support 18.

In the foregoing specification, the invention has been described with reference to a specific exemplary embodiment thereof. It will, however, be evident that various modifications and changes may be made thereunto without departing from the broader spirit and scope of the invention as set forth in the appended claims. The specification is, accordingly, to be regarded in an illustrative rather than a restrictive sense.

What is claimed is:

1. An orifice assembly for emitting a stream of fluid under high pressure comprising:

an orifice member having an aperture therein through which a high pressure fluid is emitted as said stream;

a support member disposed downstream of said orifice member, said support member providing support for said orifice member, said support member comprising means for permitting flexure of said support member such that a tensile stress is generated in said support member in response to the application of high pressure fluid to said orifice member and having a passageway therein in communication with the aperture in the orifice member, whereby the orifice member is allowed to move in response to the application of high pressure fluid;

a housing having an opening for receiving said orifice member and support member therein; and means for retaining said orifice member and support member in said housing.

2. The orifice assembly recited in claim 1, wherein said housing further comprises a nozzle member having an opening therein in communication with the passageway in the support member and the aperture in the orifice member through which the stream of fluid from said orifice member is emitted.

3. The orifice assembly recited in claim 1, wherein said support member comprises an annular member with said passageway comprising a central opening therein in communication with the aperture in the orifice member through which said stream of fluid from said orifice member flows, said means for permitting flexure including said annular member having a gap adjacent said housing on a downstream surface of said annular member, said gap at least in part closing upon the application of high pressure fluid to said orifice member.

4. The orifice assembly recited in claim 3, wherein said gap is no more than 0.005 inch deep.

5. The orifice assembly recited in claim 1, wherein said support member comprises a metal.

6. The orifice assembly recited in claim 5, wherein said support member comprises a stainless steel.

7. The orifice assembly recited in claim 1, wherein said support member comprises an annular member with said passageway comprising a central opening therein in communication with the aperture in the orifice member through which said stream of fluid from said orifice member flows, said means for permitting flexure including said annular member comprising a central core section about said opening with two flanges extending radially from said core section and made integrally with said core section.

8. The orifice assembly recited in claim 7, wherein an annular opening in said support member between said flanges deforms by at least party closing in response to the application of high pressure fluid to said orifice member.

9. The orifice assembly recited in claim 1, wherein said retaining means comprises a retainer ring for engaging said orifice member and a retainer having a flange adjacent said retainer ring for holding said retainer ring, thereby holding said orifice member in position in said housing.

10. The orifice assembly recited in claim 9, wherein said orifice member is slidably retained in said retainer.

11. A support member for a high pressure fluid jet orifice member adapted to be disposed in a housing, the orifice member adapted to produce a fluid jet stream, the support member comprising:

an annular member having an upstream surface adapted to support the orifice member and having a central opening therein in communication with an aperture in the orifice member and through which the fluid jet stream from said orifice member flows, said annular member comprising means for permitting flexure of said annular member such that a tensile stress is generated in said annular member in response to the application of high pressure fluid to the orifice member, thereby allowing the orifice member to move in response to the application of the high pressure fluid.

12. The support member recited in claim 11, wherein said means for permitting flexure includes said annular member having a gap adjacent said housing on a downstream surface of said annular member, said gap at least in part closing upon the application of high pressure fluid to said orifice member.

13. The support member recited in claim 12, wherein said gap is no more than 0.005 inch deep.

14. The support member recited in claim 11, wherein said annular member comprises a metal.

15. The support member recited in claim 14, wherein said annular member comprises a stainless steel.

16. The support member recited in claim 11, wherein said means for permitting flexure includes said annular member comprising a central core section about said opening with two flanges extending radially from said core section and made integrally with said core section.

17. The support member recited in claim 16, wherein an annular opening in said annular member between said flanges deforms by at least party closing in response to the application of high pressure fluid to said orifice member.

18. The support member recited in claim 11, further comprising means for retaining said orifice member and support member in said housing.

19. The support member recited in claim 18, wherein said retaining means comprises a retainer ring for engaging said orifice member and a retainer having a flange adjacent said retainer ring for holding said retainer ring, thereby holding said orifice member in position in said housing.

20. The support member recited in claim 19, wherein said orifice member is slidably retained in said retainer.

21. A method for mounting a fluid jet orifice member from which a high pressure fluid jet stream is produced, the method comprising:

mounting the orifice member on a support member in a cavity in a housing, the support member being disposed downstream of the orifice member and having an opening therein for allowing fluid to flow through the support member; and providing means within said support member for permitting flexure of said support member and allowing the support member to flex such that a tensile stress is generated in said support member in response to the application of high pressure fluid to the orifice member, thereby allowing the orifice member to move in response to the application of the high pressure fluid.

22. The method recited in claim 21, wherein said step of allowing the support member to flex comprises closing a gap, at least in part, between said support member and the housing.

23. The method recited in claim 22, further wherein said step of allowing the support member to flex comprises closing, at least in part, an annular opening provided in the support member.

24. The method recited in claim 23, wherein said step of closing, at least in part, the annular opening comprises closing an annular opening provided along the periphery of the support member.

25. The method recited in claim 21, further wherein said step of allowing the support member to flex comprises closing, at least in part, an annular opening provided in the support.

26. The method recited in claim 25, wherein said step of closing, at least in part, the annular opening comprises closing an annular opening provided along the periphery of the support member.

27. A method for minimizing damage to a fluid jet orifice from which a high pressure fluid jet stream is produced, the method comprising:

mounting the orifice member on a support member in a cavity in a housing, the support member being disposed downstream of the orifice member and having an opening therein for allowing fluid to flow through the support member; and providing means within said support member for permitting flexure of said support member and allowing the support member to flex such that a tensile stress is generated in said support member in response to the application of high pressure fluid to the orifice member, thereby allowing the orifice member to move in response to the application of the high pressure fluid and reducing shock to the orifice member due to cycling on and off of said high pressure fluid.

28. The method recited in claim 27, wherein said step of allowing the support member to flex comprises closing a gap, at least in part, between said support member and the housing.

29. The method recited in claim 28, further wherein said step of allowing the support member to flex comprises closing, at least in part, an annular opening provided in the support member.

30. The method recited in claim 29, wherein said step of closing, at least in part, the annular opening comprises closing an annular opening provided along the periphery of the support member.

31. The method recited in claim 27, further wherein said step of allowing the support member to flex comprises closing, at least in part, an annular opening provided in the support member.

32. The method recited in claim 31, wherein said step of closing, at least in part, the annular opening comprises closing an annular opening provided along the periphery of the support member.

* * * * *